US006940033B1

(12) United States Patent
Jones, Jr. et al.

(10) Patent No.: US 6,940,033 B1
(45) Date of Patent: Sep. 6, 2005

(54) WDS SWITCH

(76) Inventors: Walter E. Jones, Jr., 6251 Eagleridge Cir., Pinson, AL (US) 35126; Derrick A. Hood, 2123 Fuhrman Rd., Southside, AL (US) 35907

( * ) Notice: Subject to any disclaimer, the term of this patent is extended or adjusted under 35 U.S.C. 154(b) by 490 days.

(21) Appl. No.: 10/254,933

(22) Filed: Sep. 26, 2002

(51) Int. Cl.[7] ..... H01H 13/02
(52) U.S. Cl. ..... 200/522; 409/230
(58) Field of Search ..... 200/331, 329, 200/522; 409/230, 231, 232, 233, 234

(56) References Cited

U.S. PATENT DOCUMENTS 3,602,728 A 8/1971 Carpenter
3,767,876 A 10/1973 Batson
4,428,055 A * 1/1984 Zurbrick et al. ..... 700/160
4,707,921 A 11/1987 Meyer et al.
4,935,733 A 6/1990 Munekata
5,445,479 A * 8/1995 Hillinger ..... 408/16
5,681,214 A 10/1997 Kleider
5,918,685 A * 7/1999 Ulbrich et al. ..... 173/4
6,050,759 A * 4/2000 Bone ..... 409/182
6,579,215 B2 * 6/2003 Katoh et al. ..... 483/30
6,717,080 B1 * 4/2004 Chan et al. ..... 200/200
6,749,028 B1 * 6/2004 Chan et al. ..... 173/170
6,752,750 B2 * 6/2004 Adachi et al. ..... 483/31

* cited by examiner

*Primary Examiner*—Richard K. Lee
(74) *Attorney, Agent, or Firm*—Patent & Trademark Services Inc.; Joseph H. McGlynn

(57) ABSTRACT

A switch mechanism that can be attached to a conventional cordless power tool. The switch is attached to the power pack on the cordless tool and when turned on starts the tool thereby eliminating the need to keep constant pressure on the conventional pressure switch associated with such tools.

11 Claims, 3 Drawing Sheets

WDS SWITCH

BACKGROUND OF THE INVENTION

This invention relates, in general, to switches, and, in particular, to switches to allow remote operation of a cordless tool.

DESCRIPTION OF THE PRIOR ART

In the prior art various types of devices have been proposed. For example, U.S. Pat. No. 3,767,876 to Batson discloses a remote switch for a power tool such as a router.

U.S. Pat. No. 3,602,728 to Carpenter discloses a remote operated tool which uses a coil to turn on the tool.

U.S. Pat. No. 5,681,214 to Kleider discloses a hand power tool with a remote handle to operate the tool.

U.S. Pat. No. 4,935,733 to Munekata discloses a remote control receiver which responds to a coded receiver from a transmitter to turn a device on and off.

U.S. Pat. No. 4,707,921 to Meyer discloses an exterior handle for a tool that removable attaches to the handle for remote control of the tool.

The present invention is designed to be used in high risk environments to allow mechanical tasks to be performed without creating additional risks to humans. The present invention, for example, would allow cordless tools to be used by law enforcement robots at the scene of a high risk entry. A robotic device could be equipped with the present invention and the cordless tool could be operated by a remote operator of the robot. The remote operator, through the use of the switch of the present invention, could operate the cordless tool, which normally has a depression switch which must be constantly depressed to operate the tool, without constantly depressing the conventional switch on the cordless tool.

SUMMARY OF THE INVENTION

The present invention is directed to a switch mechanism that can be attached to a conventional cordless power tool. The switch is attached to the power pack on the cordless tool and when turned on starts the tool thereby eliminating the need to keep constant pressure on the conventional pressure switch associated with such tools.

It is an object of the present invention to provide a new and improved switch for cordless power tools.

It is an object of the present invention to provide a new and improved switch for cordless power tools that can be added to any cordless power tool.

It is an object of the present invention to provide a new and improved switch for cordless power tools that can be easily and quickly added to any power tool.

These and other objects and advantages of the present invention will be fully apparent from the following description, when taken in connection with the annexed drawings.

DESCRIPTION OF THE PREFERRED EMBODIMENT

Figure 1:
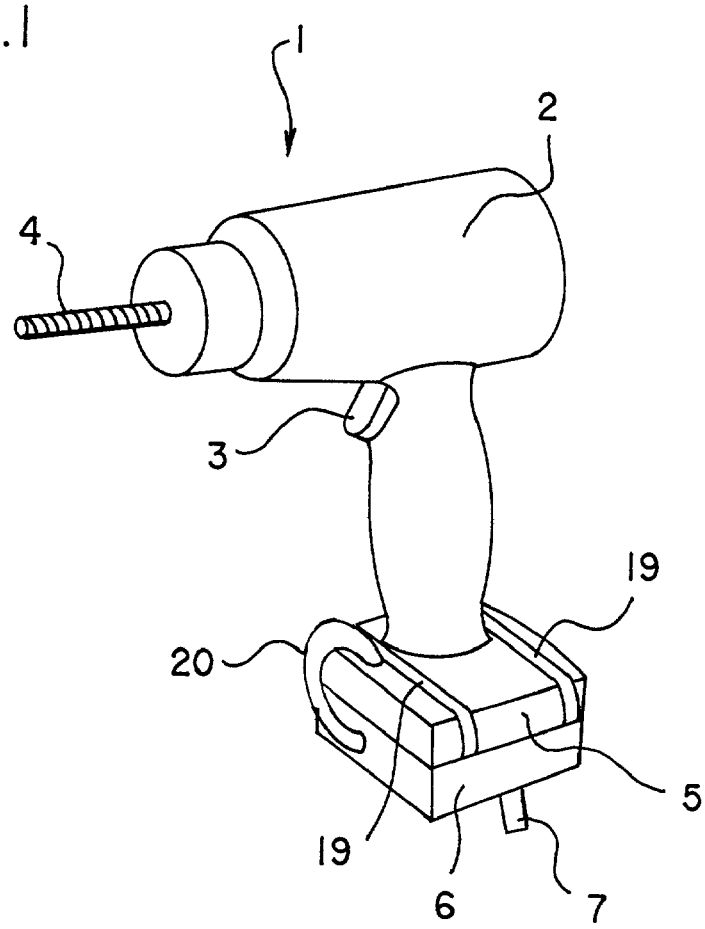
FIG. 1 is a perspective view of the present invention attached to a cordless drill.

Referring now to the drawings in greater detail, FIG. 1 shows the present invention 1 attached to a conventional cordless power tool 2, in this case a cordless drill, with a drill bit 4 attached in the conventional manner. It should be noted that the drill in FIG. 1 is used merely for illustration purposes, and other cordless power tools could be used with the present invention. The drill 2 has a conventional trigger switch 3 and a battery pack 5 to power the tool. The switch 3 is a conventional pressure switch used on cordless tools which must be held depressed by the user in order to operate the cordless tool 2. The add-on device 6 of the present invention is secured to the battery pack 5 and has a switch 7 which, when operated, will bypass the conventional switch 3 to operate the cordless tool 2. The preferred method of securing the device 6 to the tool 2 is to use hook and loop fastener straps 19, although other fasteners could be used without departing from the scope of the invention.

Figure 5:
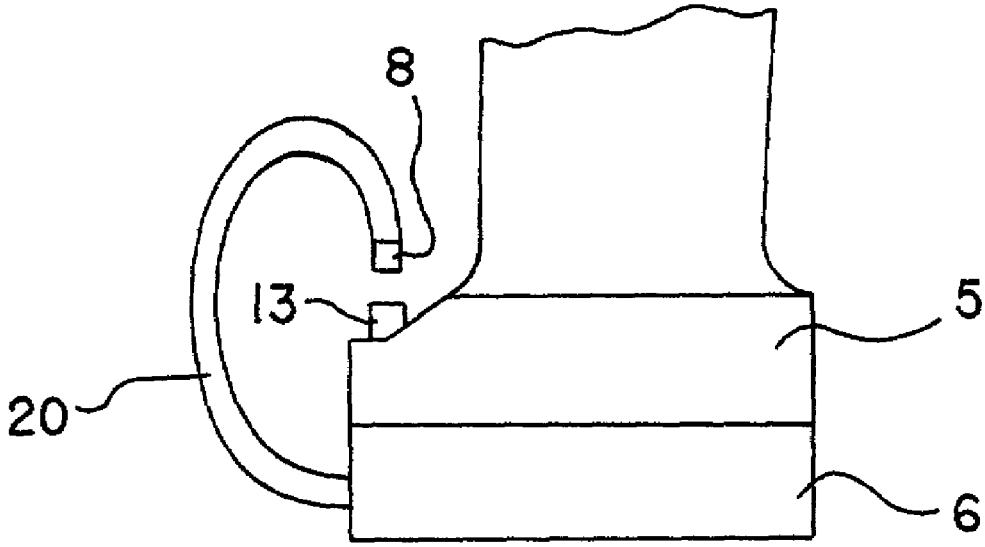
FIG. 5 is a partial view showing the electrical connection between the switch of the present invention and the conventional battery pack.

The device 6 is electrically connected to the tool 2 by an electrical cord 20 which has a plug 8 on one end (see FIG. 5). The plug 8 is connected to a socket 13, to electrically connect the device 6 to the internal wiring of the tool 2 through the housing of the tool 2 just above the battery pack 5.

Figure 2:
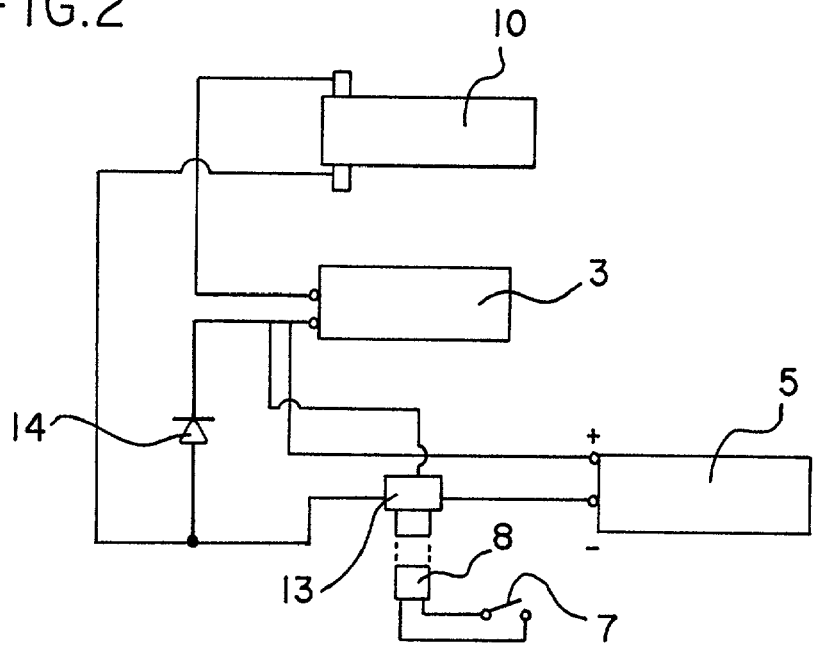
FIG. 2 is an electrical schematic view of the wiring of the present invention.
Figure 3:
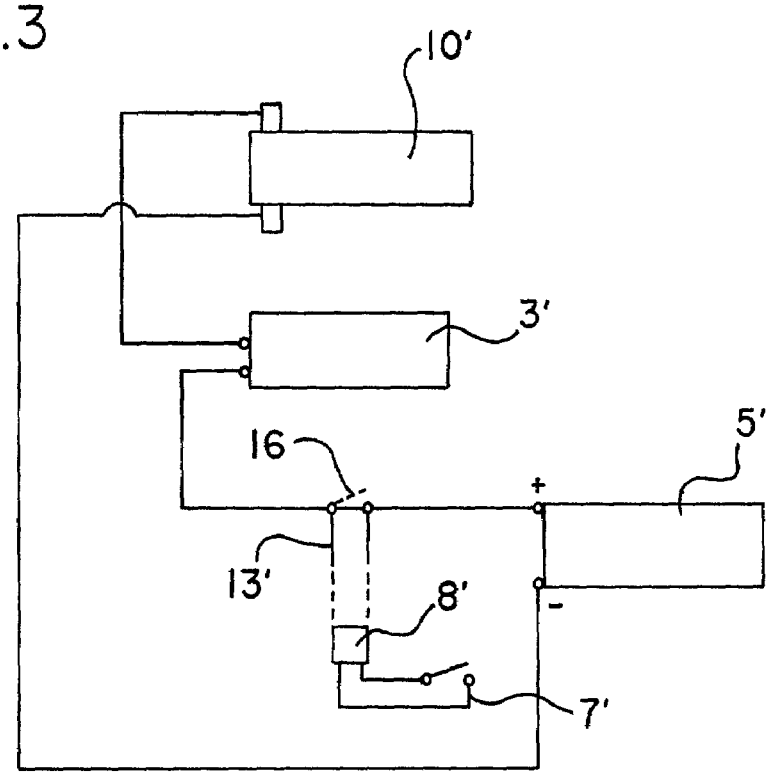
FIG. 3 is an electrical schematic view of another embodiment of the wiring of the present invention.
Figure 4:
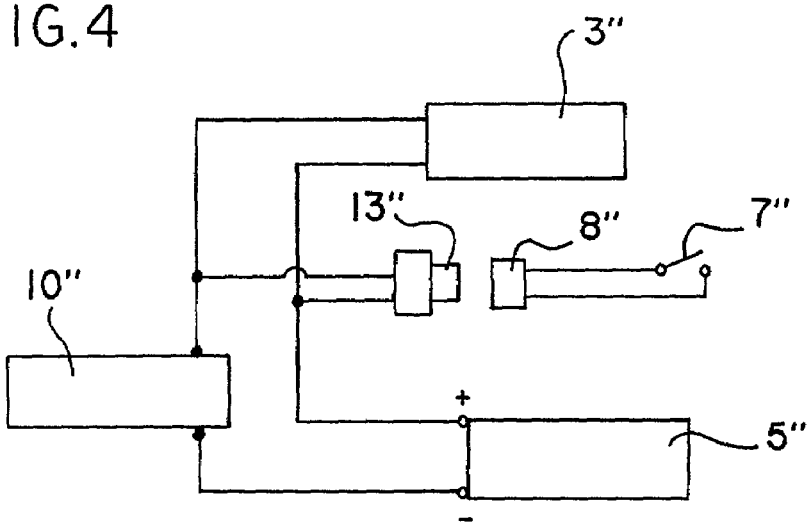
FIG. 4 is an electrical schematic view of another embodiment of the wiring of the present invention.

The switch 7, as shown in the wiring shown in FIGS. 2–4 allows the switch 7 to be activated and eliminates the need to keep the conventional switch 3 depressed in order to operate the tool 2. This would allow the cordless tool to be secured to, and operated by, a robotic device which would not be able to maintain the conventional switch 3 depressed in order to operate the tool 2.

As shown in FIG. 2, the present invention is electrically connected by means of a plug 8 and a socket 13 to the conventional internal wiring of the tool 2. The preferred plug 8 and socket 13 is a BNC plug and socket, however, any connector that will accomplish the same results can be used without departing from the scope of the invention. Normally, when operating the tool 2, the user presses the pressure switch 3 and holds the switch to operate the tool. When the switch 3 is released, the tool stops. Also, this type of tool usually incorporates a reverse switch, so the direction the cordless drill rotates can be reversed. For example, if the user wants to remove a screw (as opposed to installing a screw) he/she can turn the reverse switch and then press the switch 3 to remove a screw. Since the reverse switch is conventional, it has not been shown in the drawing for clarity. Also, the switch of the present invention is not reversible.

When the switch 7 is moved to the "on" position, electricity will flow from the battery 5 through the connector 8, 13 to the motor 10 bypassing the conventional switch 3. Since the switch 7 is not a pressure switch, the motor 10 and the tool will operate without holding the switch in a depressed condition. This will allow a robot operator to operate the tool in a more convenient and simplified manner. The diode 14 prevents current flowing back to the battery 5 when the normal switch 3 is used. This allows the tool 2 to be used in the normal manner, i.e. by depressing and keeping the switch 3 depressed, or by operating the switch 7 of the present invention.

The circuit shown in FIG. 3 is similar to the circuit of FIG. 2 and similar elements are used with a "prime" designation in FIG. 3. In the FIG. 3 circuit, an additional switch 16 is interposed between the connector 13' and plug 8' and switch 7. The switch 16 is normally closed which allows pressure switch 3' to control the motor 10'. In order to insert switch 7' into the circuit and disconnect switch 3' from the circuit, plug 8' is inserted into connector 13'. When this happens, plug 8' opens switch 16 which disconnects switch 3' from the circuit. Power from the battery now runs through switch 7', which is an on/off switch, and the the motor 10' will not operate unless switch 7' is closed. Switch 16 is similar to the switch used on stereos to plug in headphones. When the headphones are plugged in, the normal speakers are disconnected from the circuit, and sound comes only through the headphones.

The circuit shown in FIG. 4 is similar to the circuits of FIGS. 1 and 2 and similar elements are used with a "double prime" designation in FIG. 4. In the FIG. 4 circuit, the switch 7" is placed in parallel with the switch 3" so either switch 3" or 7" can be used to operate the tool.

Although the WDS Switch and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

We claim:

1. A cordless tool having a handle, a motor, a battery and a pressure switch for connecting said battery with said motor and operating said motor, and means for bypassing said pressure switch and for connecting said battery with said motor and operating said motor, means for mechanically connecting said means for bypassing said pressure switch to said cordless tool, and means for electrically connecting said means for bypassing said pressure switch to said battery and to said motor.

2. The cordless tool as claimed in claim 1, wherein said means for bypassing said pressure switch is a switch that does not have to be held in the on position.

3. The cordless tool as claimed in claim 1, wherein said means for bypassing said pressure switch is an on/off switch which remains in the on or off position once activated without any further action by a user.

4. The cordless tool as claimed in claim 3, wherein there is a second on/off switch electrically connected between said means for bypassing said pressure switch and said cordless tool.

5. The cordless tool as claimed in claim 4, wherein said second on/off switch is normally in an on condition, and said second on/off switch is moved to an off condition when said means for bypassing said pressure switch is connected to said tool.

6. The cordless tool as claimed in claim 1, wherein said means for means for mechanically connecting said bypassing said pressure switch to said cordless tool is at least one strap.

7. The cordless tool as claimed in claim 6, wherein said at least one strap has hook and loop fasteners to secure said means for bypassing said pressure switch to said cordless tool.

8. The cordless tool as claimed in claim 6, wherein said at least one strap is secured to a base of said cordless tool.

9. The cordless tool as claimed in claim 1, wherein said means for electrically connecting said means for bypassing said pressure switch to said battery and to said motor comprises a first connector on said means for bypassing said pressure switch, and a second connector on said cordless tool, and at least one electrical wire is connected between said first and second connector.

10. The cordless tool as claimed in claim 9, wherein said first and second connectors are BNC connectors.

11. The cordless tool as claimed in claim 9, wherein said first connector has a first and a second contact, and said second connector has a first and a second contact, and said first contact on said second connector is electrically connected to said battery, and said second contact on said second connector is electrically connected to said motor.

* * * * *